US005847315A

United States Patent [19]

Katzakian, Jr. et al.

[11] Patent Number: 5,847,315

[45] Date of Patent: Dec. 8, 1998

[54] SOLID SOLUTION VEHICLE AIRBAG CLEAN GAS GENERATOR PROPELLANT

[75] Inventors: Arthur Katzakian, Jr., Elk Grove; Henry Cheung, Livermore; Charles E. Grix, Sacramento; Donald C. McGehee, Carmichael, all of Calif.

[73] Assignee: Ecotech, Rancho Cordova, Calif.

[21] Appl. No.: 758,431

[22] Filed: Nov. 29, 1996

[51] Int. Cl.[6] ..... C06B 45/10

[52] U.S. Cl. ..... 149/19.91; 149/19.1; 149/36; 149/46

[58] Field of Search ..... 149/19.1, 19.91, 149/36, 46

[56] References Cited

U.S. PATENT DOCUMENTS

| | | | |
|---|---|---|---|
| 3,401,156 | 9/1968 | Lovett et al. | 149/19.91 |
| 3,657,028 | 4/1972 | Pannell | 149/19.91 |
| 3,729,351 | 4/1973 | Kruse . | |
| 3,790,416 | 2/1974 | Dehm | 149/19.1 |
| 3,791,893 | 2/1974 | Hill . | |
| 3,798,087 | 3/1974 | Hill . | |
| 3,898,112 | 8/1975 | Strecker et al. . | |
| 3,926,696 | 12/1975 | Klunsch et al. . | |
| 4,070,212 | 1/1978 | Mackey et al. . | |
| 4,111,728 | 9/1978 | Ramnarace | 149/19.5 |
| 4,128,996 | 12/1978 | Garner et al. . | |
| 4,152,891 | 5/1979 | Garner . | |
| 4,203,787 | 5/1980 | Kirchoff et al. . | |
| 4,369,079 | 1/1983 | Shaw . | |
| 4,507,161 | 3/1985 | Sujansky et al. | 149/21 |
| 4,632,714 | 12/1986 | Abegg et al. | 149/2 |
| 4,696,705 | 9/1987 | Hamilton . | |
| 4,701,227 | 10/1987 | Loverro | 149/47 |
| 4,806,180 | 2/1989 | Goetz et al. . | |
| 4,836,255 | 6/1989 | Schneiter et al. . | |
| 4,865,667 | 9/1989 | Zeuner et al. . | |
| 4,994,123 | 2/1991 | Patrick et al. | 149/2 |
| 5,035,757 | 7/1991 | Poole . | |
| 5,382,050 | 1/1995 | Thompson . | |
| 5,411,615 | 5/1995 | Sumrail et al. . | |
| 5,415,429 | 5/1995 | Fisher . | |
| 5,424,449 | 6/1995 | Rothgery et al. . | |
| 5,439,537 | 8/1995 | Hinshaw . | |
| 5,458,706 | 10/1995 | Finck et al. . | |
| 5,460,668 | 10/1995 | Lyon . | |
| 5,462,306 | 10/1995 | Barcaskey . | |
| 5,466,313 | 11/1995 | Brede et al. . | |
| 5,472,231 | 12/1995 | France . | |
| 5,472,647 | 12/1995 | Blau et al. . | |
| 5,507,891 | 4/1996 | Zeigler . | |
| 5,545,272 | 8/1996 | Poole et al. | 149/48 |

*Primary Examiner*—Edward A. Miller
*Attorney, Agent, or Firm*—James M. Ritchey

[57] ABSTRACT

An ignitable solid gas generating composition comprises a polyalkylammonium binder, usually polyvinylamine nitrate or polyethyleneimmonium nitrate, an oxidizer mixture comprising ammonium nitrate and a first additive which produces an eutectic melt which is liquid at a temperature well below the melting point of the ammonium nitrate as well as that of the first additive, and an additional quantity of the ammonium nitrate and a second additive. Further, combustion modifier additives may be added to the composition.

13 Claims, No Drawings

SOLID SOLUTION VEHICLE AIRBAG CLEAN GAS GENERATOR PROPELLANT

BACKGROUND OF THE INVENTION

1. Field of the Invention

Compositions are disclosed that produce the rapid generation of non-toxic gases at high pressures. More particularly, methods for preparation and ignitable solid gas generating compositions are described that find use in situations that require the rapid generation of high pressure gases with associated low solids and toxicity production. In particular, the subject invention describes a process utilizing ammonium nitrate based eutectic oxidizer mixtures in combination with polyalkylammonium nitrate binders to create solid solution propellants.

2. Description of the Background Art

The subject invention relates to compositions and preparation procedures for the rapid generation of non-toxic gases at high pressures for such purposes as the inflation means of airbags used in vehicles to protect passengers and other means wherein a high pressure gas source is needed to perform mechanical or other functions. In the prior art there are described various means for accomplishing such similar and diverse functions. Some examples follow: a compressed gas means; a volatile liquid means; a decomposing solid means; and various combustion means. The present invention relates to the latter category of means. Relevant examples of patents relating to the various indicated means are presented below and some of their more obvious advantages and disadvantages are noted.

U.S. Pat. Nos. 5,472,231 and 5,415,429 describe compressed gas systems for vehicle airbag inflation. An advantage of this type of inflator is that an inert gas may be used. Serious disadvantages are potential leakage and system weight.

U.S. Pat. No. 5,466,313 describes gas sources containing liquefied gas mixtures in which the liquefied gas components consist of a mixture of one or more ethers, olefins, ammonia or hydrogen and nitrous oxide under pressure. Potential leakage and the use of toxic substances are disadvantages of this system.

Alkali metal azides are commonly used decomposable solids for the inflation of airbags. There exist a number of U.S. patents describing various embodiments employing such substances. Some examples are: U.S. Pat. Nos. 5,462,306, 5,382,050, 4,836,255, 4,806,180, 4,696,705 and 4,203,787. An advantage of using alkali metal azides as the primary ingredient is the production of principally nitrogen as the inflating agent. One serious disadvantage is the production of alkali metal from the azide decomposition. Since as much as a third by weight of the azide could be metal, an obvious disadvantage is that an elaborate filtering system has to be incorporated to remove and contain the very reactive metal. A further disadvantage of an azide containing device is the difficulty of azide disposal after the expiration of useful life. For example, sodium azide is a Class B explosive. It is a also a highly toxic material. It easily reacts with water to form hydrazoic acid which is a highly toxic explosive gas that readily reacts with heavy metals such as copper, lead, etc. to form extremely sensitive ignitable and detonable solids. In a demolished vehicle, an azide airbag could easily become a water pollutant or toxic waste.

In order to avoid the problems associated with azides, various non-azide systems have appeared in the prior art.

Hinshaw and Blau described in U.S. Pat. No. 5,439,537 the use of thermite compositions which consist of an oxidizable inorganic fuel, such as a metal, and an oxidizing agent, such as a metal oxide. A pyrotechnic composition consisting of tartaric acid, sodium chlorate, and calcium hydroxide was proposed by Garner in U.S. Pat. No. 4,152,891. Another pyrotechnic composition consisting of a thermoplastic resin, an alkali metal chlorite, and calcium or magnesium hydroxide was presented by Garner and Hamilton in U.S. Pat. No. 4,128,996. A nitrogen generation method by reactions of nitrides with an inorganic oxidizer was given in U.S. Pat. No. 4,865,667 by Zeuner and Holzinger. A number of U.S. Patents, for example, U.S. Pat. Nos. 5,472,647, 5,460,668, 5,035,757 and 4,369,079, described the use of azole compounds such as aminotetrazole, tetrazole, bitetrazole, as well as triazole compounds and metal salts of these compounds in combination with an inorganic oxidizer. In all of these approaches to replace azide systems, a solid product was invariably produced. Attempts were made, however, to produce a more easily filterable solid; nevertheless, a filter contributing an added cost to the system was still involved.

Attempts have also been made to combine a combustion means with a compressed gas means. For example, Zeigler in U.S. Pat. No. 5,507,891 described such a hybrid system. The hot combustion products from a propellant composition based on nitramine, a binder, and an oxidizer are used to heat and so further increase the pressure of a mixture of argon and oxygen already pressurized to 2000 to 5000 psi. Although a smokeless propellant was proposed to avoid having to filter solid particles resulting from combustion, this arrangement still suffers from potential leakage of gas under high pressure.

More closely related to this invention are applications based upon the combustion of various types of solid propellants as the gas source. U.S. patents in this area cover a period of more than thirty years. We cite below several representative issues.

In U.S. Pat. No. 3,791,893, William E. Hill presented a fast burning double-base propellant. He incorporated a nitro derivative of a carborane compound, 1-nitro-2-carboranylpropene (NIPC), into conventional double-base formulation to achieve burning rates in excess of five inches per second at 2,000 psi. His compositions contained approximately 10% nitrocellulose, 50% ammonium perchlorate, 15% aluminum powder, 15% triethyleneglycoldinitrate (TEGDN), plus 6 to 12% NIPC. Typically, such compositions have flame temperatures exceeding 2000° K. Significant quantities of particulate aluminum oxide as well as hydrogen chloride are generated, both of which are serious disadvantages for use in automotive airbag applications.

In a subsequent patent, U.S. Pat. No. 3,798,087, Hill described a fast burning composite propellant. He reacted tetrafluorohydrazine with 1-isopropenylcarborane to add the $NF_2$ groups to the alkenyl group of 1-isopropenylcarborane. He than added this adduct (referred to as NFIPC) as a plasticizer and burning rate modifier to a composite propellant formulation. A representative composition consists substantially as follows:

| Component | Wt % |
|---|---|
| Binder (Hydroxyterminated polybutadiene) | 11 |
| NFIPC | 11 |
| Ammonium perchlorate (12 MICRONS) | 63 |

-continued

| Component | Wt % |
|---|---|
| Aluminium powder | 15 |
| Total | 100 |

This formulation showed a burning rate of 1.17 in/sec at 1,000 psi. Quite obviously a significant quantity of particulate aluminum oxide and hydrogen chloride are produced upon combustion. The flame temperature would exceed 2000° K. These are negative aspects of the propellant for use in automotive gas bag applications.

In U.S. Pat. No. 4,070,212, Mackey and Foster disclosed the use of finely milled ammonium perchlorate (<3 micron) in conjunction with n-butyl ferrocene as a burning rate catalyst to enhance the combustion rate of a composite propellant. Their formulation consists of 7 to 15% carboxyl-terminated polybutadiene, 62 to 82% ammonium perchlorate, greater than 0 to 18% aluminum, and greater than 0 to 8% n-butyl ferrocene. The aspects of aluminum oxide, hydrogen chloride, and flame temperature mentioned above also apply here.

In U.S. Pat. No. 5,458,706, Bernard Finck et al used, as plasticizer for the thermoplastic binder, a polybutadiene with silylferrocene groups. The plasticizer also serves as a burning rate modifier. Their formulations consist generally of ammonium perchlorate and sodium nitrate as oxidizers. Aluminum may or may not be included as a fuel. They achieved a burning rate of 2 in/sec at 3000 psi with a pressure exponent of 0.37 for a non-aluminized formulation. In addition to a mixture of essentially non-toxic gases a significant quantity of sodium chloride is present in the combustion products.

Strecker and Haiss disclosed in U.S. Pat. No. 3,898,112 a solid gas generating propellant based upon 5-aminotetrazole nitrate as the oxidizer and a copolymer consisting of styrene-butadiene-styrene and styrene-isoprene-styrene as fuel. In this proposed non-azide system, no solid material is produced upon combustion. As described, it was significantly under oxidized so that excessive carbon monoxide would be expected to be in the combustion product gas to render it unsuitable for passenger airbag applications.

Sumrall et al. in U.S. Pat. No. 5,411,615 described the use of a four component eutectic consisting of dicyandiamide, ammonium nitrate, guanidine nitrate and ethylene diamine dinitrate as a bonding agent for an insensitive high explosive. The ingredients of the explosive, aluminum, RDX, and ammonium perchlorate were added to the liquified eutectic mixture at 185° F. in the mixer. After blending, the mixture was cooled and solidified to form a finely dispersed or uniform propellant grain. This composition produces significant solids and toxic hydrochloric acid which are not desirable in automotive gas bag applications.

Kruse et al described in U.S. Pat. No. 3,729,351 the fabrication of flares by dry blending of metal powders and ground binary or ternary eutectic mixtures of alkali and alkaline earth metal nitrates. The mixed powders were put in a casing and heated to melting below 230° C. Upon cooling, as in the previous cited patent, a uniform physical mixture of the ingredients was obtained. The use of metal powder makes this mixture unsuitable for airbag inflators without the costly addition of filters.

Yet another example of the use of eutectic mixtures was given by Klunsch et al in U.S. Pat. No. 3,926,696. Various multicomponent eutectics, an example of which consists of 11% ammonium nitrate, 45% ethanolamine nitrate, 16% methylamine nitrate, 16% methylamine perchlorate and 12% urea, were used to formulate explosives which remain liquid below −10° C. An example of such an explosive contained 52.5% ammonium nitrate, 3% sodium nitrate, 22.5% of the eutectic mixture and 22% aluminum. The eutectic served to keep ingredients in a slurry state. The liquid or slurry state makes these compositions unsuitable for automotive air bag inflators.

It is to be noted that in all of the foregoing employments of the eutectic mixtures cited above, their chemical nature did not play an important role in their usage. They only served to hold the reactive solids in an immobile state.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to disclose a formulation of a solid combustible composition, the burning of which produces only non-toxic gases such as nitrogen, carbon dioxide, and water vapor.

Another object of the present invention is to provide a formulation of a solid combustible composition, the burning of which produces only non-toxic gases such as nitrogen, carbon dioxide, and water vapor and generates little or virtually no solid products so that no inflator filter is required for the automotive airbag application.

A further object of the present invention is to achieve a linear burning rate of >1.2 in/sec at 2900 psi for a formulation of a solid combustible composition, the burning of which produces only non-toxic gases such as nitrogen, carbon dioxide, and water vapor.

Still another object of the present invention is to limit the combustion flame temperature to 2000° K or less for a formulation of a solid combustible composition, the burning of which produces only non-toxic gases such as nitrogen, carbon dioxide, and water vapor.

Yet a further object of the present invention is to achieve a peak decomposition exotherm temperature of 200° C. or greater as measured by differential scanning calorimeter (DSC) for a formulation of a solid combustible composition, the burning of which produces only non-toxic gases such as nitrogen, carbon dioxide, and water vapor.

An additional objective of the present invention is to attain a solid density such that 1 cc of the propellant will generate at least 0.06 gram-moles of non-toxic gas for a formulation of a solid combustible composition, the burning of which produces only non-toxic gases such as nitrogen, carbon dioxide, and water vapor.

Contained in the enumeration of the objectives above is the elimination of certain disadvantages in the cited work. In addition, the state of the art was advanced in several respects as will be evident below. In the process unexpected and unique paths to the objectives were discovered.

Disclosed is an ignitable solid gas generating composition that comprises a polyalkylammonium binder (usually polyvinylamine or polyethylene imine in a nitric acid salt form and with a molecular weight of at least about 50,000), an oxidizer mixture comprising ammonium nitrate (AN) and a first additive which produces an eutectic melt which is liquid at a temperature well below the melting point of the ammonium nitrate as well as that of the first additive, and, often, an additional quantity of the ammonium nitrate and a second additive.

Usually, the first additive is selected from a group consisting of hydrazine nitrate (HN), guanidine nitrate (GN), and aminoguanidine nitrate (AGN). Preferably, the oxidizer mixture comprises at least about 57% of the propellant composition with the additional quantity of ammonium nitrate and a second additive, having the second additive selected from a group consisting of 5-aminotetrazole nitrate (ATZN) and urea nitrate (UN).

Often the subject composition further comprises a combustion modifier additive, wherein the combustion modifier additive comprises a mixture of alkali or alkaline earth chloride and chromium nitrate. Usually, the alkali or alkaline earth chloride is either potassium or sodium chloride. Often, the combustion modifier additive comprises a 5-aminotetrazole complex of chromium (III), iron (III), copper (II) or mixtures thereof.

In addition, we have found, surprisingly, that the addition of small amounts (about 1–3%) of polyoxyethylene (Polyox) polymers to these propellant formulations enhances the vigor with which these propellants burn at ambient temperature and pressure. Propellants containing these polyethers polymers and a burning rate catalyst such as chromium 5-aminotetrazole complex (CrATZ) burn more vigorously when ignited than propellants without this polymer. With or without this polymeric additive propellant ignition at ambient temperature is still difficult, which means that chance ignition is highly unlikely. Ignition at elevated pressures using proper igniters take place readily.

Additionally the process of forming the composition is disclosed and claimed. More specifically, a process for forming a solid solution, ignitable, gas generating composition is disclosed and comprises the steps of selecting a polymeric binder and mixing with the polymeric binder a liquid eutectic oxidizer. Usually, the eutectic oxidizer comprises binary mixtures of ammonium nitrate and guanidine nitrate, ammonium nitrate and aminoguanidine nitrate, or ammonium nitrate and hydrazine nitrate.

Other objects, advantages, and novel features of the present invention will become apparent from the detailed description that follows, when considered in conjunction with the associated chemical depictions.

DESCRIPTION OF THE PREFERRED EMBODIMENT

Disclosed is a solid solution type formulation that addresses the negative aspects of the gas generating formulations in the above discussed prior art. A high molecular weight polymer has been found that when blended with liquid oxidizers (ammonium nitrate based eutectics) to achieve an oxygen balanced system, produced a rubbery propellant when held just above the eutectic melting point. The rubbery propellant becomes a firm, tough amorphous solid solution propellant when cooled below the eutectic melting point. Preferably, the high molecular weight polymer is polyvinylammonium nitrate (PVAN) or commonly known as polyvinylamine nitrate. Alternatively, a high molecular weight polymer that can be used in place of PVAN is polyethyleneimmonium nitrate (PEIN) or commonly called polyethyleneimine nitrate.

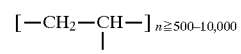

PVAN

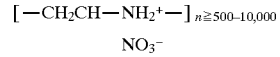

PEIN

One example of an AN based eutectic is hydrazine nitrate/ammonium nitrate in a 65/35 weight ratio, respectively. This eutectic melts at ~47° C. When melted and combined with PVAN it forms a rubbery propellant by "swelling" into it. The resulting propellant burns cleanly and rapidly. When combined with a burning rate catalyst such as CrATZ and the like at a 2% level, a burning rate of ~0.1 in/sec was measured at ambient temperature and pressure (as performed in a standardize test setting). In a series of measurements under pressure, the burning rates were approximately 0.57 and 0.86 in/sec at 1000 and 1500 psi, respectively. When extrapolated to 3000 psi the burning rate is approximately 1.7 in/sec. It is noted that for every gram of the catalyst used, less than about 0.2 gram of solid $Cr_2O_3$ residue is produced. This is important for vehicle airbag inflators since residue in the gas envelope is undesirable.

Another burning rate catalyst is chromium nitrate. Not only is the $Cr(NO_3)_3.9H_2O$ a good burning rate enhancer with low residue production, but it is soluble in the eutectic oxidizer; it also provides nitrogen gas and is a better net oxidizer per gram than ammonium nitrate. Analysis of the combustion gases showed that the carbon monoxide (CO) concentration was within the acceptable range (<6000 ppm as per governmental standards) and the NOX concentration was also well below the acceptable range. Otherwise the only gases generated were nitrogen, carbon dioxide and water vapor.

Polyox is added to enhance combustion. Since it is not soluble in the eutectic oxidizer and since it is a liquid at mix temperature, sorbitan monosterate is added to aid dispersion.

In order to achieve formulations with dimensional stability ≧110° C., a higher melting eutectic than that achieved with HN/AN was needed. We found that guanidine nitrate and aminoguanidine nitrate form eutectic melting points with ammonium nitrate (AN), respectively, at ~130° C. and ~113° C. The eutectic compositions by weight are AN/GN, 84.5/15.5 by weight and AN/AGN, 75/25 by weight. The AGN confers ~20° C. greater thermal stability by DSC (~250° C.) to the eutectic than does GN (~230° C.), however, both eutectics have more than ample stability. Propellants were formulated with polyvinylamine nitrate polymer and CrATZ and the chromium nitrate burning rate catalysts and were oxygen balanced with the eutectic oxidizers to produce water, carbon dioxide, and nitrogen gases. Other additives such as 5-aminotetrazole nitrate, urea nitrate, and equivalent compounds may also be used in these formulations as combustion modifiers.

The PVAN is prepared by first polymerizing vinylformamide with a free radical initiator such as a peroxide or an azo compound. Other initiators such as sodium persulfate or ultraviolet light can be used. The polymer average molecular weight (MW) should be ~500,000 to one million or greater, but can be used down to 50,000 MW. This polymer is then hydrolyzed with caustic to produce polyvinylamine. Addition of nitric acid produces the desired polyvinylamine nitrate.

The PEIN is prepared by polymerizing ethyleneimine and converting the resulting polymer to the nitric acid salt in similar fashion to PVAN.

The formulations have excellent ignition and burning characteristics at ambient temperatures and elevated pressures. At atmospheric pressure most of the formulations developed and tested would not easily initiate combustion. This is a good safety feature, which ensures that accidental ignition is not likely to take place under normal use conditions.

A typical desired stoichiometric formulation consists of approximately 16.4% PVAN, 81.6% eutectic oxidizer, and 2% burning rate modifier. It was found that such formulations could maintain dimensional stability at temperatures as high as about 110° C.

The density and chemical composition of a typical subject formulation are such that one cubic centimeter of the typical formulation yields approximately 0.063 gram-mole of gaseous combustion product consisting essentially of carbon dioxide, nitrogen, and water. Solid material resulting from combustion of one cubic centimeter of this propellant is less than about 0.006 grams.

The subject formulations have very acceptable thermodynamic properties. The flame temperature by thermodynamic calculation is less than about 2000 K. Ignition onset temperatures are ~200° C. and peak exotherms range from about 230°–250° C. The subject formulations also have exceptional thermal stability. They have survived accelerated aging at 140° C. for ~120 hours without perceptible deterioration. The relative insensitivity to ignition of these systems is typified by the following values for the HN/AN eutectic gas generator propellant.

TABLE 1

| Formulation Sensitivities | |
|---|---|
| Impact Sensitivity | >200 kg-cm for the HN/AN eutectic |
| Friction Sensitivity | >300 lb at 3 ft-sec for the HN/AN eutectic |

The state of the art has been advanced by virtually eliminating solid combustion products, lowering of the flame temperature, general improvement in thermal stability, significantly increasing the volume of non-toxic gases generated per gram of propellant, all in a solid solution propellant formulation consisting primarily of an inorganic eutectic nitrate oxidizer and polyalkylammonium nitrate polymer. Minor formulation constituents consist of combustion catalysts and ballistic additives.

The following ingredients and proportions are determined so that the desired burning rate and mechanical properties can be obtained with an oxygen balanced composition.

TABLE 2

| Formulations | |
|---|---|
| Ingredient | Approximate Weight % |
| Polyvinylamine nitrate binder | 8 to 20 |
| Eutectic of HN/AN | 57 to 83 |
| Additional AN and eutectic additive beyond that used in the initial eutectic composition | 0 to 20 |
| Combustion modifier additive | 0 to 6 |

It is herein disclosed that in order to form a true solid solution propellant, the binder must be soluble in the liquid eutectic oxidizer and the liquid eutectic oxidizer must be able to "swell" into the binder. This "swelling" can be regarded as plasticizing or solvating the polymer. Chemical affinities between the binder and the eutectic oxidizers are necessary. Most high molecular weight water soluble or water swellable linear or branched polymers do not possess the necessary affininity for the eutectic oxidizers described in this application and or have oxygen demands for combustion that are far too high to be useful. Some examples of these non-useful polymers are polyvinyl alcohol, polyacrylic acid, polyacrylonitrile, and polyvinylformamide. In light of these facts, PVAN and PEIN are unique polymers for the formulation of the subject solid solution propellants. Heretofore, eutectic mixtures have served primarily to provide a physical encapsulation for other components of the system as cited in several of the patents above. The eutectic and binder did not form a molecularly intimate composition in these instances. Consequently, the usually seen boundary between binder and oxidizer is not eliminated.

EXAMPLES

The following are examples that typify the compositions and process of the subject invention and are for exemplary purposes only. The polymer binder used throughout all these examples is PVAN, MW ~600 K. All the oxidizers are eutectics composed of ammonium nitrate and a selected nitrate salt. The burning rate catalysts consist principally of the $Cr^{3+}$, $CU^{2+}$ and $Fe^{3+}$ metal ions in either nitrate salt ($CrNO_3$, $CuNO_3$ and $FeNO_3$) or complex form (CrATZ (chromium$^{3+}$ triaminotetrazolate), CuATZ (copper$^{2+}$ diaminotetrazolate), and FeATZ (iron$^{3+}$ trimanotetrazolate)). The nitrate salts are, respectively, in the nonahydrate, sesquipentahydrate and nonahydrate form. Other salts or complexes of these salts may be used, but usually they either add undesirable constituents to the combustion gases or they add an unacceptable oxygen demand to the formulation.

Example 1

This formulation uses the eutectic of ammonium nitrate hydrazinium nitrate, 35/65 by weight, respectively. This eutectic melts at ~47° C.

| Propellant ingredient | Weight % |
|---|---|
| AN/HN eutectic | 81.00 |
| PVAN | 17.00 |
| $CrNO_3$ | 2.00 |

The eutectic oxidizer was heated to ~60° C. to melt it and the $CrNO_3$ crystals were dissolved into the liquid oxidizer. After solution was complete, the PVAN powder was stirred into the catalyzed liquid oxidizer and then degassed under vacuum. The propellant thickened as the liquid oxidizer swelled into the polymer binder. The degassed liquid propellant was cast into a mold and allowed to cool. It solidified into a solid solution propellant. The burning rate at 1000 psi was found to be 0.77 in/sec and the combustion gas composition was <6,000 ppm CO and <400 ppm NOX.

Example 2

This example illustrates how AN can be added beyond that in the eutectic oxidizer to modify softening temperature of the propellant, alter combustion properties and increase available oxygen for binder combustion.

| Propellant ingredient | Weight % |
|---|---|
| AN/HN eutectic | 71.00 |
| AN | 10.00 |
| PVAN | 17.00 |
| $CrNO_3$ | 2.00 |

The oxidizer which consisted of the eutectic and added AN had to be heated to ~70° C. in order to be completely liquified. The propellant was processed at ~80° C. Processing and casting were done as described in Example 1. The burning rate of this formulation was found to be 0.65 in/sec at 1000 psi and the combustion gas composition was <9,000 ppm CO and <500 ppm NOX.

Example 3

This formulation in this example contained KCl as a combustion additive in addition to the $CrNO_3$ and was found to promote more efficient conversion of CO to $CO_2$ than was accomplished with $CrNO_3$ alone.

| Propellant ingredient | Weight % |
|---|---|
| AN/HN eutectic | 82.00 |
| PVAN | 17.00 |
| $CrNO_3$ | 0.50 |
| KCl | 0.50 |

This propellant formulation was processed as described in Example 1

Example 4

The eutectic in this example consists of AN/GN (guanidinium nitrate) in an 84.5/15.5 weight ratio. This eutectic melts at 128° C. This higher melting eutectic confers dimensional stability on the resulting solid solution propellant to >110° C.

| Propellant ingredient | Weight % |
|---|---|
| AN/GN eutectic | 83.36 |
| PVAN | 13.38 |
| CrATZ | 3.26 |

This propellant was processed at 135° C. using the same procedure outlined in Example 1. The burning rate was determined to be 0.27 in/sec at 1000 psi. A sample of this propellant was aged 140° C. for 120 hours. A differential scanning calorimeter (DSC) scan of this material at 10° C./min was only slightly changed from a DSC scan conducted on an unaged sample. The propellant was found to be impact and friction insensitive using standard test methods.

Example 5

The formulation in this example was identical to that in Example 4 except that 1% FeATZ was substituted for 1% of CrATZ. The burning rate of this propellant was 0.33 in/sec at 1000 psi, indicating possible synergism with this catalyst combination.

Example 6

Aminoguanidinium nitrate was used with AN in the weight ratio of 75/25, AN/AGN, to produce a eutectic oxidizer combination that melted at 112° C.

| Propellant ingredient | Weight % |
|---|---|
| AN/AGN eutectic | 86.39 |
| PVAN | 10.35 |
| CrATZ | 3.26 |

This propellant was processed at 123° C. which was ~10° C. lower than the processing temperatures for formulation #s 5 & 6. Thermal analysis by DSC at 10° C./minute in air indicated a peak exotherm nearly 20° C. higher than for the propellants made with the AN/GN eutectic. The burning rate for this propellant was measured at 0.30 in/sec at 1000 psi. The processing procedure used in Example 1 was used to make this formulation.

Example 7

| Propellant ingredient | Weight % |
|---|---|
| AN/GN eutectic | 84.75 |
| PVAN | 11.50 |
| CrATZ | 2.00 |
| Polyox | 1.50 |
| DHAP | 0.20 |
| Sorbitan monostearate | 0.05 |

This formulation uses the Polyox to improve the propellant combustion. The dihydrogenammonium phosphate (DHAP) was added to improve the propellant stability. The sorbitan monostearate helps to disperse the Polyox since it is not soluble in the liquid eutectic oxidizer. This propellant burns more vigorously than a similar propellant without Polyox. It had the same burning rate at 1000 psi as did formulation #6, even though formulation #6 had >1% more CrATZ than did formulation #7.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An ignitable solid gas generating composition comprising:

a) a polyalkylammonium binder, wherein said polyalkylammonium binder is polyvinylamine nitrate and b) an oxidizer mixture comprising ammonium nitrate and a first additive which produces an eutectic melt which is liquid at a temperature well below the melting point of said ammonium nitrate as well as that of said first additive.

2. A composition according to claim 1, further comprising an additional quantity of said ammonium nitrate and a second additive.

3. A composition according to claim 1, further comprising a combustion modifier additive.

4. The composition according to claim 1, wherein said polyvinylamine nitrate has a molecular weight of at least about 50,000.

5. The composition according to claim 1, wherein said first additive is selected from a group consisting of hydrazine nitrate, guanidine nitrate, and aminoguanidine nitrate.

6. The composition according to claim 2, wherein said oxidizer mixture comprises at least about 57% of the wherein additional quantity of ammonium nitrate and a second additive, having said second additive selected from a group consisting of 5-aminotetrazole nitrate and urea nitrate.

7. The composition according to claim 6, wherein said oxidizer mixture comprises ammonium nitrate and hydrazine nitrate.

8. The composition according to claim 6, wherein said oxidizer mixture comprises ammonium nitrate and guanidine nitrate.

9. The composition according to claim 6, wherein said oxidizer mixture comprises ammonium nitrate and aminoguanidine nitrate.

10. The composition according to claim 3, wherein said combustion modifier additive comprises a mixture of alkali or alkaline earth chloride and chromium nitrate.

11. The composition according to claim 10, wherein said alkali or alkaline earth chloride is either potassium or sodium chloride.

12. The composition according to claim 3, wherein said combustion modifier additive comprises a 5-aminotetrazole complex of chromium (III), iron (III), copper (II) or mixtures thereof.

13. An ignitable solid gas generating composition comprising:

a) a polyalkylammonium binder comprising polyvinylamine nitrate and b) an oxidizer mixture comprising ammonium nitrate and a first additive which produces an eutectic melt which is liquid at a temperature well below the melting point of said ammonium nitrate as well as that of said first additive, wherein said first additive is guanidine nitrate.

* * * * *